US010018004B2

(12) United States Patent
Abrant et al.

(10) Patent No.: US 10,018,004 B2
(45) Date of Patent: Jul. 10, 2018

(54) METHOD AND APPARATUS FOR CASING ENTRY

(71) Applicant: Scientific Drilling International, Inc., Houston, TX (US)

(72) Inventors: William R. Abrant, Houston, TX (US); Charles A. Butterfield, Jr., Houston, TX (US); Gerald Heisig, Spring, TX (US)

(73) Assignee: SCIENTIFIC DRILLING INTERNATIONAL, INC., Houston, TX (US)

( * ) Notice: Subject to any disclaimer, the term of this patent is extended or adjusted under 35 U.S.C. 154(b) by 734 days.

(21) Appl. No.: 14/335,312

(22) Filed: Jul. 18, 2014

(65) Prior Publication Data

US 2015/0021029 A1 Jan. 22, 2015

Related U.S. Application Data

(60) Provisional application No. 61/856,395, filed on Jul. 19, 2013.

(51) Int. Cl.

| | |
|---|---|
| ***E21B 29/00*** | (2006.01) |
| ***E21B 29/02*** | (2006.01) |
| ***E21B 29/06*** | (2006.01) |
| ***E21B 29/08*** | (2006.01) |

(52) U.S. Cl.

CPC ..... *E21B 29/02* (2013.01); *E21B 29/06* (2013.01); *E21B 29/08* (2013.01)

(58) Field of Classification Search

USPC ..... 166/55.3

See application file for complete search history.

(56) References Cited

U.S. PATENT DOCUMENTS 2,105,722 A * 1/1938 Barrett ..... E21B 7/061 166/117.6
2,633,682 A * 4/1953 Jackson ..... E21B 10/48 175/434
2,815,932 A * 12/1957 Wolfram ..... E21B 10/66 173/138

(Continued)

FOREIGN PATENT DOCUMENTS

| | | |
|---|---|---|
| DE | 10313436 A1 | 10/2004 |
| GB | 2254430 A | 10/1992 |
| WO | 2013107462 A2 | 7/2013 |

OTHER PUBLICATIONS

International Search Report and Written Opinion issued in International Application No. PCT/US2014/047218, dated Dec. 22, 2014 (12 pages).

*Primary Examiner* — D. Andrews
*Assistant Examiner* — Ronald R Runyan
(74) *Attorney, Agent, or Firm* — Adolph Locklar

(57) ABSTRACT

According to one aspect of the disclosure, an intercept well for penetrating an existing tubular is drilled. A casing entry tool is provided in the intercept well and operated to form at least one aperture in the wall of the existing casing. The casing entry tool may be oriented toward the target tubular. In some embodiments, a generally concave notch may be positioned on the casing entry tool and adapted to engage with the convex outer surface of the target tubular. In some embodiments, a locking mechanism may retain the orientation of the casing entry tool within the intercept well.

56 Claims, 15 Drawing Sheets

(56) References Cited

U.S. PATENT DOCUMENTS

| | | | | |
|---|---|---|---|---|
| 4,072,200 | A * | 2/1978 | Morris | E21B 7/04 175/45 |
| 4,472,884 | A * | 9/1984 | Engebretson | G01V 7/16 33/304 |
| 5,230,387 | A * | 7/1993 | Waters | E21B 7/068 175/45 |
| 5,361,859 | A * | 11/1994 | Tibbitts | E21B 10/20 175/286 |
| 6,199,633 | B1 | 3/2001 | Longbottom | |
| 6,257,353 | B1 | 7/2001 | Belew et al. | |
| 6,283,230 | B1 | 9/2001 | Peters | |
| 2011/0290501 | A1 * | 12/2011 | Duncan | E21B 21/106 166/363 |
| 2014/0174740 | A1 | 6/2014 | Parlin | |

* cited by examiner

METHOD AND APPARATUS FOR CASING ENTRY

CROSS-REFERENCE TO RELATED APPLICATIONS

This application is a non-provisional application which claims priority from U.S. provisional application No. 61/856,395, filed Jul. 19, 2013.

TECHNICAL FIELD/FIELD OF THE DISCLOSURE

The present disclosure relates to entering tubular sections positioned underground. In particular, the present disclosure relates to gaining hydraulic access to the inner bore of an existing tubular, tubing, or drillpipe by penetrating the tubular through external means.

BACKGROUND OF THE DISCLOSURE

During the life cycle of an oil well, an operator may need to gain hydraulic access to an existing cased wellbore when the wellbore is not accessible by typical re-entry procedures. For example, during the creation of the wellbore, if the wellbore penetrates a zone with pressure higher than the hydrostatic mud weight in the wellbore and pressure control systems fail, a blowout may occur that may result in the release of oil and/or natural gas. One method to control such a blowout is to drill a relief well to intercept the blowout wellbore.

As another example, at the end of a well's life cycle, a well is plugged and abandoned. Occasionally, the plugged and abandoned (P&A) well is improperly abandoned and may leak. Such a situation may require the drilling of an intercept well to fix and properly abandon the well.

In another example, during the drilling or completion phase of the well, a tubular "fish" or damaged tubular section may have been left in the well. An intercept well may be drilled to re-enter the wellbore to secure continued use of the wellbore and/or set abandonment plugs.

To gain hydraulic access to the existing cased wellbore, an operator may need to drill the intercept wellbore. Once the operator has drilled the intercept wellbore sufficiently close to the existing wellbore, a casing entry tool may be used to penetrate the existing tubular and gain hydraulic access thereto.

SUMMARY

The present disclosure provides for a downhole tool for penetrating an existing tubular such as casing, tubing, or drillpipe positioned within an earthen formation from the surface. The downhole tool may include a casing entry tool adapted to form at least one aperture in the existing tubular. The casing entry tool may include a face. The casing entry tool may include a generally concave notch adapted to engage with the convex outer surface of the existing tubular. The notch may be oriented in the same radial direction as the face of the casing entry tool.

The present disclosure also provides for a method of penetrating an existing tubular such as casing, tubing, or drillpipe positioned within an earthen formation from the surface. The method may include providing a drilling rig. The method may also include providing a drill string. The drill string may include a drill bit and a bottomhole assembly. The method may also include drilling an intercept well. The method may also include steering the drill bit to intercept the existing tubular. The method may also include running a casing entry tool into the intercept well. The casing entry tool may include a feeler plate having a generally concave notch adapted to engage with the convex outer surface of the existing tubular. The notch may be oriented in the same radial direction as a face of the casing entry tool. The method may also include orienting the casing entry tool toward the existing tubular. The method may also include cutting at least one aperture in the existing tubular with casing entry tool.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
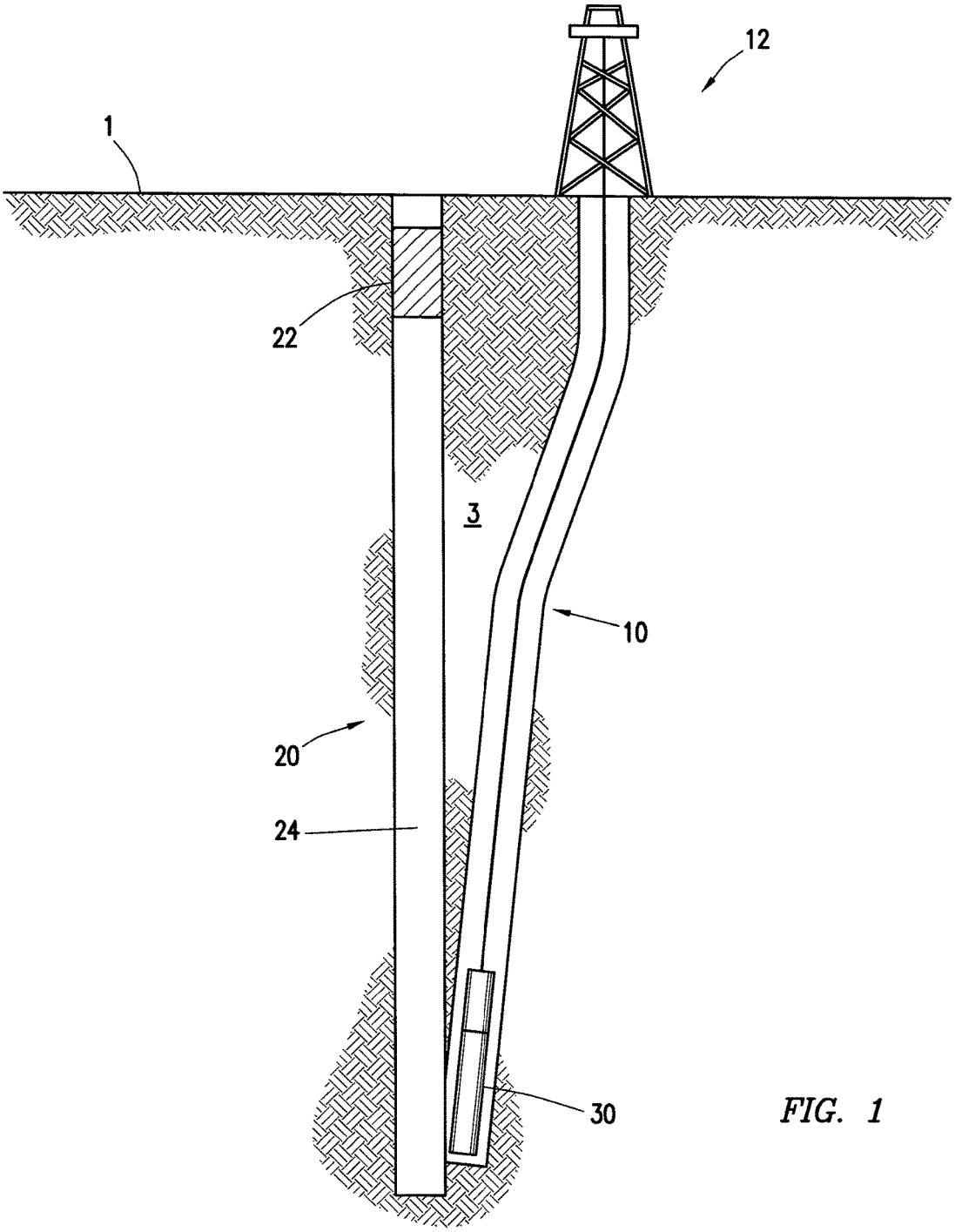
FIG. 1 is a cross-section of a casing entry operation consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts intercept well 10 drilled from the surface 1 through an earthen formation 3 towards a target tubular 20. Target tubular 20 may be an existing length of wellbore casing, tubing, or drill pipe as understood in the art placed within the earth. Target tubular 20 may be positioned in a wellbore that has become inaccessible from the surface through normal means. For example and without limitation, target tubular 20 may have experienced a blowout or, as depicted in FIG. 1, may have been previously plugged and abandoned (P&A) by plug 22. Target tubular 20 may be a non-deviated vertical well, as shown in FIG. 1, or may be a deviated or directionally drilled well including a horizontally drilled well.

To gain hydraulic access to the bore 24 of target tubular 20, intercept well 10 is drilled by drilling rig 12. Drilling rig 12 may be a drilling rig, either on land or offshore, coiled tubing (CT) rig, wireline drilling rig, or any other suitable surface drilling apparatus. In certain embodiments of the present disclosure, intercept well 10 is positioned to intercept target tubular 20 at an angle as depicted in FIG. 1. For the purposes of this disclosure, intercept well 10 intercepts target tubular 20 when it is within a target distance of the existing tubular at a selected angle of incidence. In some embodiments, the target distance may be between 0 and 24 inches. In some embodiments, the selected angle of incidence may be between 0.1 and 20 degrees. In other embodiments, the target distance may be between 0 and 15 inches. In some embodiments the selected angle of incidence may be between 3 and 5 degrees. In some embodiments, the intercept well may directly contact the target casing. Tubular 20 is considered penetrated or entered when at least one aperture has been established in target tubular 20 allowing hydraulic continuity between target tubular 20 and intercept well 10.

In some embodiments of the present disclosure, a directional drilling apparatus may be used to guide the drilling of intercept well 10 towards target tubular 20. The drilling string may include a measurement while drilling (MWD) apparatus as understood in the art. The drilling string may include magnetometers adapted to measure magnetic fields downhole. The magnetometers may be capable of detecting magnetic anomalies such as the metal used in target tubular 20. The MWD device may allow the directional drilling apparatus to steer the drilling string toward target tubular 20. The directional drilling apparatus may include without limitation a bent-sub, a steerable motor, articulating mud motor, rotary steerable system, etc. One having ordinary skill in the art with the benefit of this disclosure will understand that any suitable directional drilling apparatus may be used without deviating from the scope of this disclosure.

Figure 2A:
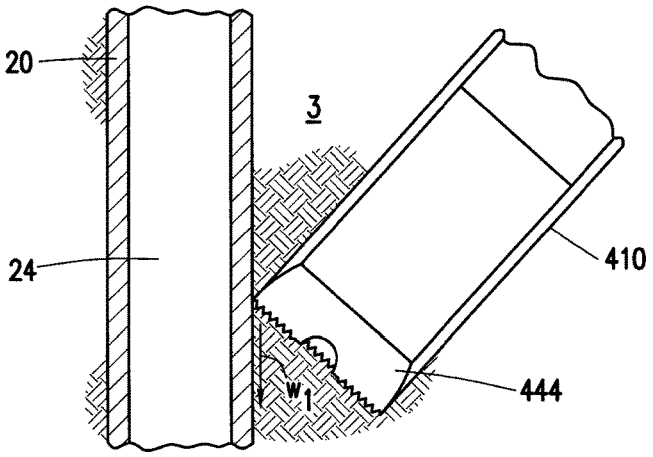
FIG. 2*a* is a detail cross-section of the intercept well and the existing tubular of FIG. 1.
Figure 2B:
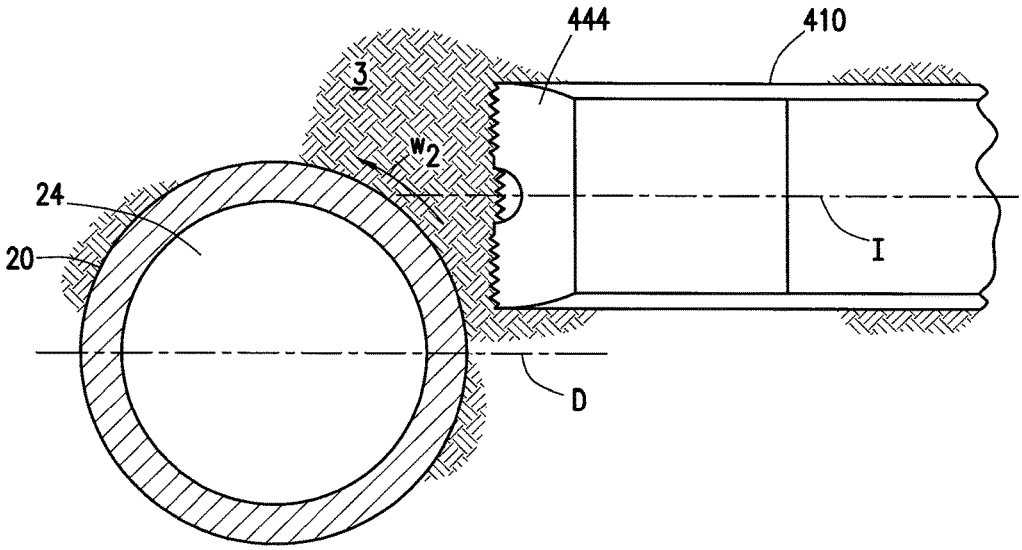
FIG. 2*b* is a detail cross-section of the intercept well and the existing tubular of FIG. 1 from a plane orthogonal to FIG. 2*a*.

Once target tubular 20 has been intercepted, it may be desirable to gain fluid access between the intercept well and the bore of target tubular 20. FIG. 2*a* depicts casing entry tool 444 near target tubular 20 at the beginning of a casing entry operation. Intercept well 410 has been drilled within a predetermined distance and angle of incidence to target tubular 20. Inaccuracy in the direction parallel to target tubular 20 may be allowable, as hydraulic access may be achieved at any point along target tubular 20 where target casing bore 24 is accessible. However, the angle between intercept well 410 and target tubular 20 may cause casing entry tool 444 to "walk" along the outside of target tubular 20. In other words, casing entry tool 444 may continue to bore out formation 3 in the direction of w1 without penetrating target tubular 20. Additionally, as depicted in FIG. 2*b*, inaccuracy in the direction perpendicular to target tubular 20 may result in difficulty penetrating the wall of target tubular 20. Due to the cylindrical nature of target tubular 20, if the centerline I of intercept well 410 is separated from the parallel centerline D of target tubular 20 by more than the radius of the casing entry tool 444, the concavity of the outer wall of target tubular 20 may cause a casing entry tool 444 to "walk" off the side of the casing along direction w2 and penetrate further into surrounding formation 3 instead of penetrating target tubular 20.

Figure 3:
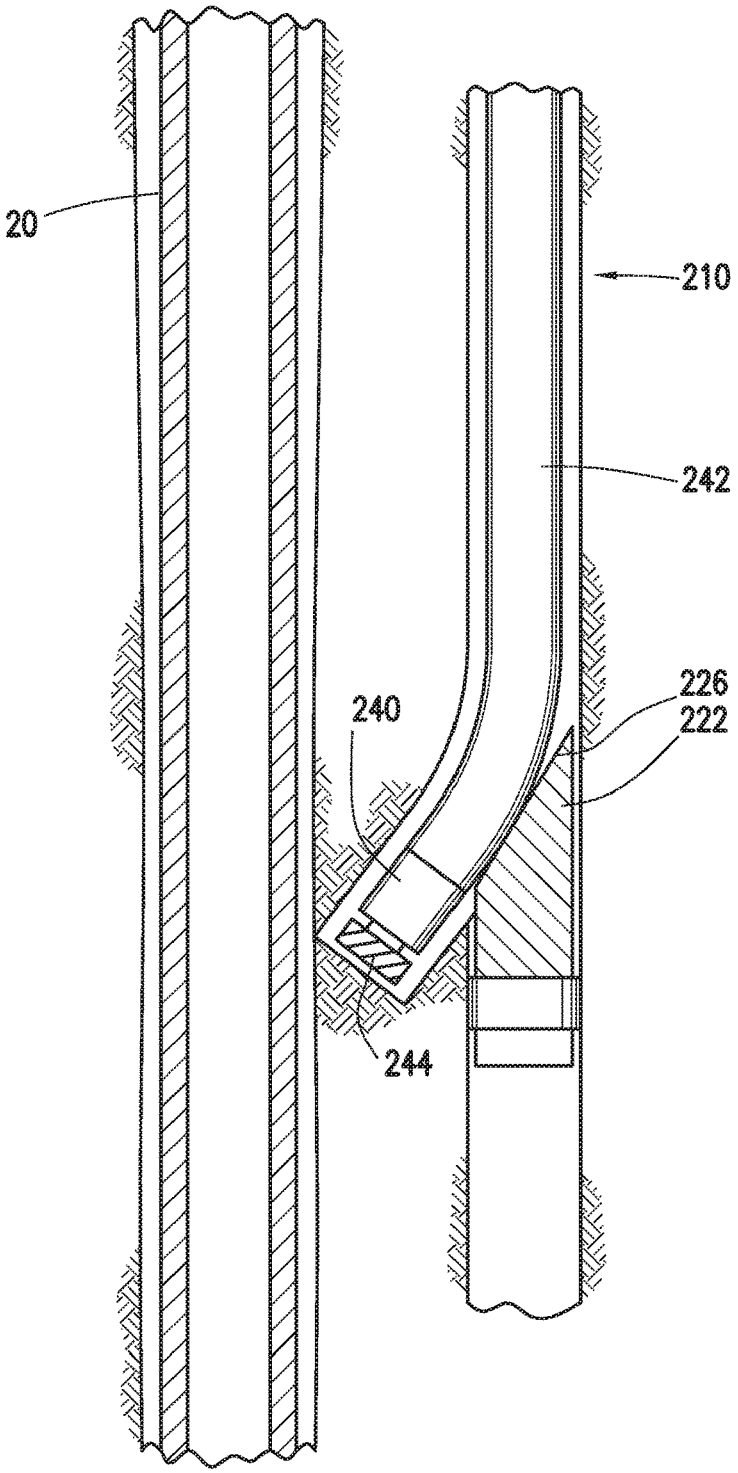
FIG. 3 is a cross-section of a casing entry operation consistent with at least one embodiment of the present disclosure.

In some embodiments, such as one depicted in FIG. 3, after intercept well 210 has been drilled, whipstock 222 may be positioned within intercept well 210. As understood in the art, whipstock 222 may include ramp 226 adapted to angle drill string 242 into the surrounding formation as it is inserted through whipstock 222. In some embodiments, drill string 242 including bottom hole assembly (BHA) 240 may be inserted into intercept well 210. Whipstock 222 may force drill string 242 to continue to drill at an angular deviation from intercept well 210. As understood in the art, BHA 240 may include, for example and without limitation, a mud motor, drilling sensors, a bent sub, etc. to assist in directional drilling and accurate interception of the target tubular 20. The angular deviation may, for example, cause drill bit 244 to be less susceptible to walk as previously described, by, for example, increasing the local angle of incidence.

Figure 4:
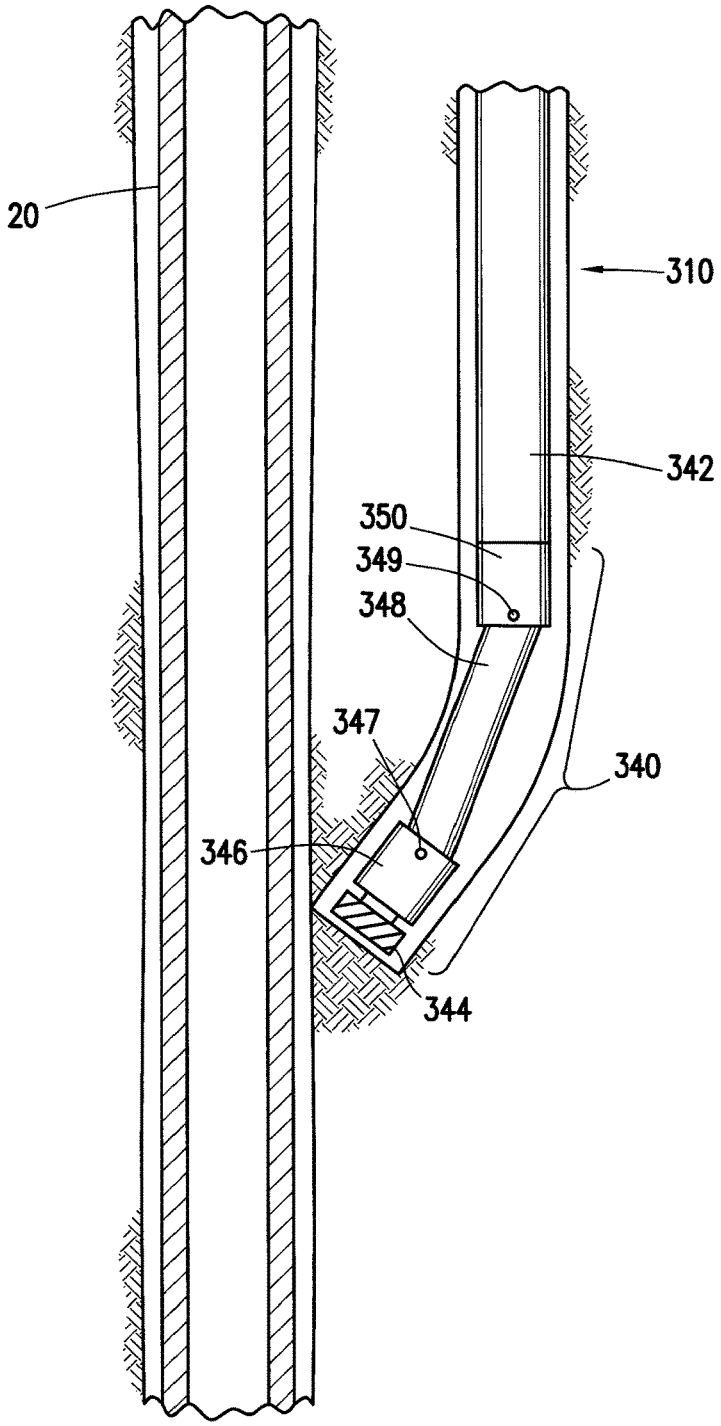
FIG. 4 is a cross-section of a casing entry operation consistent with at least one embodiment of the present disclosure.

In other embodiments of the present disclosure, an articulated short-radius drilling assembly may be utilized. FIG. 4 depicts such an embodiment. BHA 340 may include an articulated drilling motor, which may include drill bit 344 mounted on first articulating segment 346. First articulating segment 346 may, in some embodiments, be coupled to second articulating segment 348. Second articulating segment 348 may, in some embodiments, be coupled to third articulating segment 350. Third articulating segment may be coupled to intercept drill string 342. First, second, and third articulating segments 346, 348, 350 may be permitted to pivot about joints 347, 349. Although here described as including two articulation points, one having ordinary skill in the art with the benefit of this disclosure will understand that an articulated short-radius drilling assembly may include any number of articulated segments without deviating from the scope of this disclosure. BHA 340 as depicted in FIG. 4 may be driven from the surface by, for example, a rotary table or top drive in a "rotary mode", or may include a mud motor to drive it in a "sliding mode". In some embodiments, BHA 340 is used to drill intercept well from the surface under a first weight on bit (WOB). When target tubular 20 is intercepted, a second WOB may be used, which causes one or more of articulated segments 346, 348, 350, to "buckle" and therefore create an angular deviation from the original intercept well 310 to enter target casing 20. The angular deviation may cause drill bit 344 to be less susceptible to walk as previously described, by, for example, increasing the local angle of incidence. In some embodiments, the drilling and casing entry operation may be accomplished in one operation.

Figure 5A:
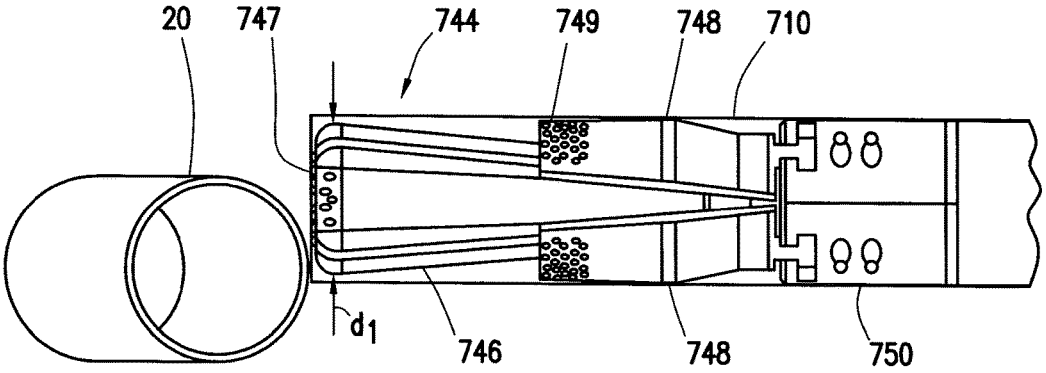
FIG. 5*a*, 5*b* are views of an expandable drill bit consistent with at least one embodiment of the present disclosure.
Figure 5B:
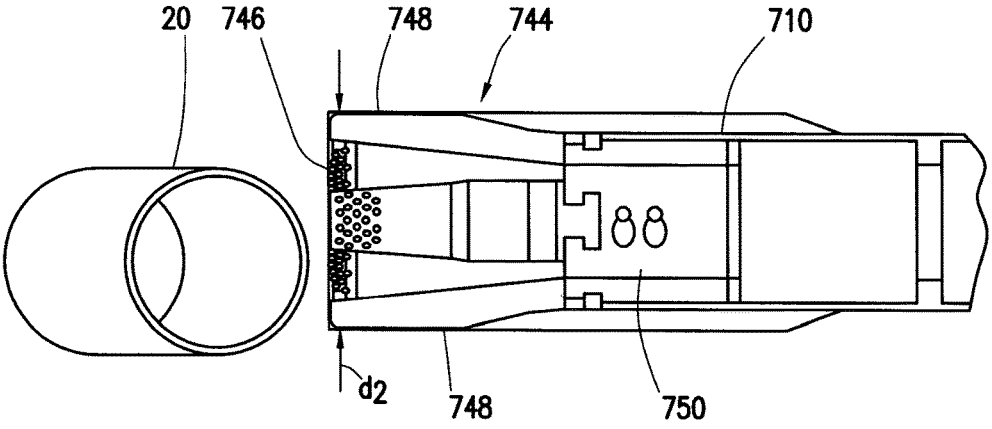

In some embodiments, as depicted in FIGS. 5*a*, 5*b*, expandable drill bit 744 may be positioned in intercept well 710. Expandable drill bit 744 may be inserted into intercept well 710 in a retracted configuration as shown in FIG. 5*a*. In some embodiments, a whipstock as previously described may be utilized to create an angular deviation of expandable drill bit 744 from intercept well 710. In some embodiments, expandable drill bit 744 may be used to drill intercept well 710 in its retracted configuration. Expandable drill bit 744 includes first cutting head 746, having first diameter d1. Expandable drill bit 744 may also include at least one expansion segment 748 positioned around first cutting head 746 and away from cutting surface 747 of first cutting head 746. The outer surface of first cutting head 746 is depicted as having a frustoconical taper which narrows away from cutting surface 747, allowing expansion segments 748 to have a diameter generally less than d1 when in the retracted configuration. Expansion segments 748 may be coupled to sliding sleeve 750. In some embodiments, sliding sleeve 750 may be slid axially along expandable drill bit 744. In some embodiments, sliding sleeve 750 may be coupled to a piston (not shown). In some embodiments, expansion segments 748 may be held in the retracted position by spring bias.

In some embodiments, once the end of intercept well 710 is reached, expandable drill bit 744 may be reconfigured into its expanded configuration as shown in FIG. 5*b*. In some embodiments, fluid pressure may be exerted on the piston, causing sliding sleeve 750 to slide toward cutting surface 747 along first cutting head 746. This motion may cause expansion segments 748 to ride along the tapered surface of first cutting head 746, thereby increasing in diameter as sliding sleeve 750 advances. In some embodiments, expandable drill bit 744 may be rotated during this operation. In some embodiments, expansion segments 748 may include lateral cutting surface 749 to, for example, ream out intercept well 710 around first cutting head 746, forming an annular space for expansion segments 748 to expand into. Once fully extended, the faces of expansion segments 748 parallel with cutting surface 747 may be generally aligned therewith, thus expanding the width of cutting surface 747 to wider diameter d2. In some embodiments, the ratio of d2 to d1 may generally be between 1.1 and 1.8. In some embodiments, the ratio of d2 to the diameter of target tubular 20 may generally be between 1.1 and 2.

At this point, expandable drill bit 744 may be used to penetrate target tubular 20. The increase in diameter of expandable drill bit 744 may increase the overlap of cutting surface 747 over the centerline of target tubular 20, thereby, for example, minimizing walking as expandable drill bit 744 penetrates target tubular 20. In some embodiments, such an arrangement may allow intercept well 710 to be drilled at a smaller diameter while maintaining a larger diameter casing entry tool.

Figure 6:
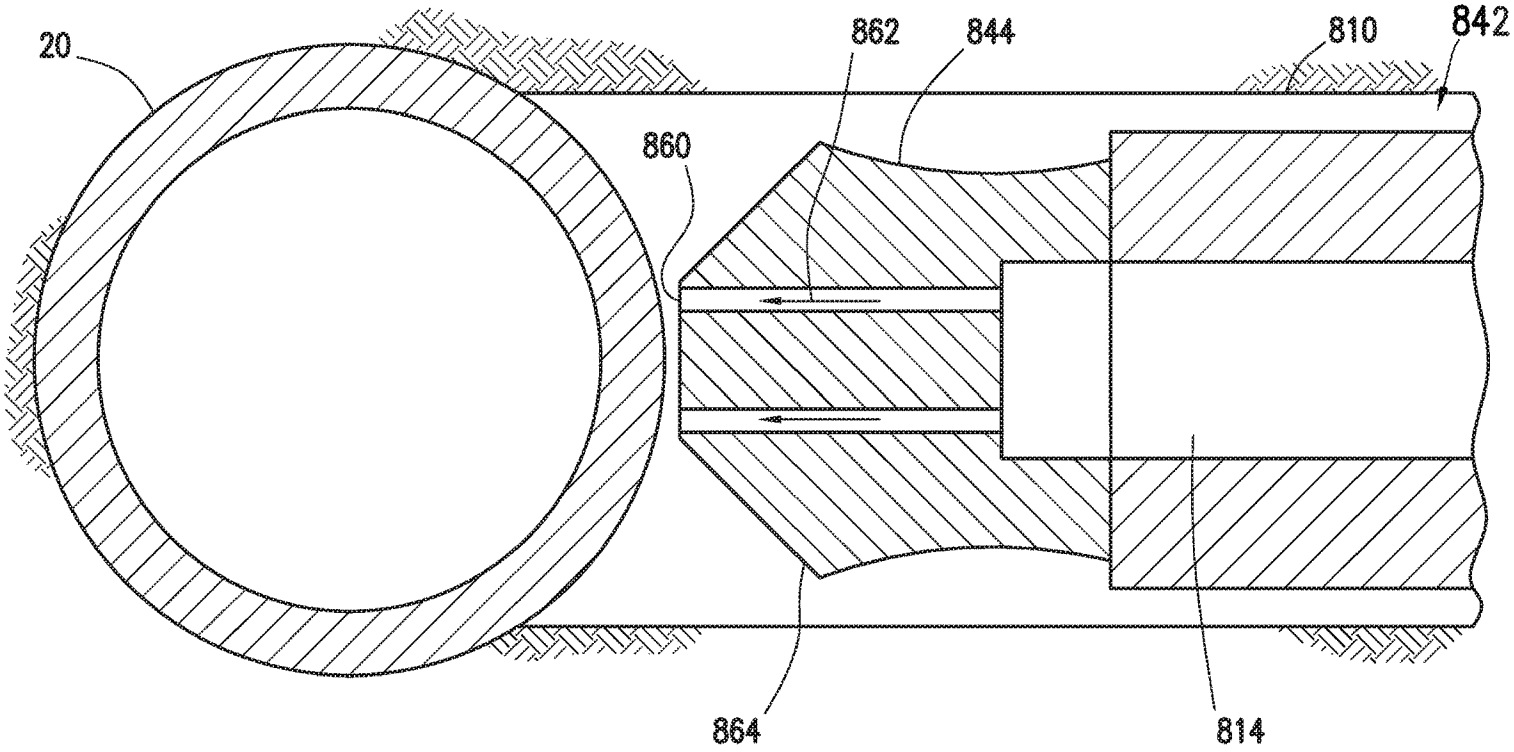
FIG. 6 is a partial cross-section of a water-jet bit consistent with at least one embodiment of the present disclosure.

In another embodiment depicted in FIG. 6, a water-jet bit 844 may be used to penetrate target tubular 20. In some embodiments, water-jet bit 844 may be positioned in intercept well 810. Water-jet bit 844 may include at least one jet nozzle 860 positioned to jet fluid 862 against target tubular 20. In some embodiments, fluid 862 may be pumped down bore 814 of casing entry string 842. In some embodiments, fluid 862 may be a mixture of high pressure fluid and abrasive material adapted to abrade target casing 20. In some embodiments, water-jet bit 844 may include a debris-clearing apparatus, here depicted as outer blade 864. In some embodiments, a whipstock as previously described may be utilized to create an angular deviation of water jet drill bit 844 from intercept well 810.

Figure 7:
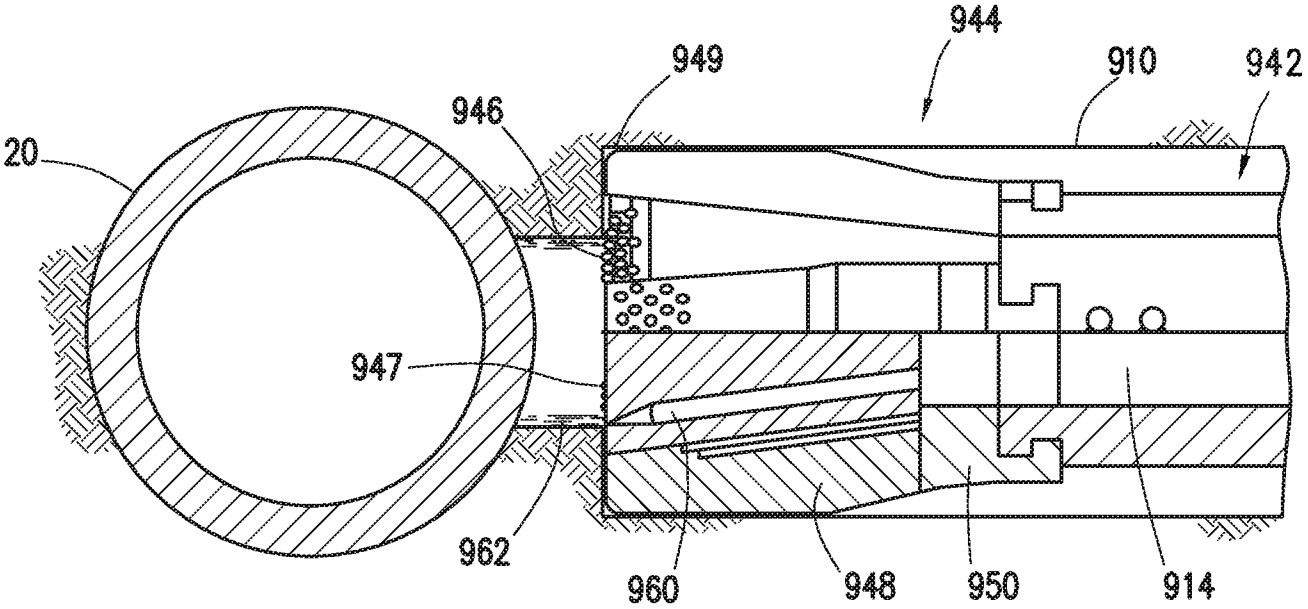
FIG. 7 is a partial cross-section of a hybrid water-jet bit consistent with at least one embodiment of the present disclosure.

In another embodiment, a water-jet nozzle may be incorporated into a conventional drill bit to provide for entry of target tubular 20. In some embodiments, a water-jet nozzle may be incorporated into an expandable drill bit as previously discussed. FIG. 7 depicts hybrid expandable water-jet drill bit 944 positioned in intercept well 910. Hybrid expandable water-jet drill bit 944 may be inserted into intercept well 910 in a retracted configuration as previously discussed. In some embodiments, hybrid expandable water-jet drill bit 944 may be used to drill intercept well 910 in its retracted configuration. Hybrid expandable water-jet drill bit 944 may include first cutting head 946, which may have width of first diameter d1. In some embodiments, hybrid expandable water-jet drill bit 944 may include at least one expansion segment 948 positioned around first cutting head 946 and away from cutting surface 947 of first cutting head 946. The outer surface of first cutting head 946 may include a frustoconical taper which narrows away from cutting surface 947, allowing expansion segments 948 to have a diameter less than d1 when in the retracted configuration. Expansion segments 948 may be coupled to sliding sleeve 950. In some embodiments, sliding sleeve 950 may be slid axially along expandable drill bit 944. In some embodiments, sliding sleeve 950 may be coupled to a piston (not shown). In some embodiments, expansion segments 948 may be held in the retracted position by spring bias.

In some embodiments, once the end of intercept well 910 is reached, hybrid expandable water-jet drill bit 944 may be reconfigured into its expanded configuration. In some embodiments, fluid pressure may be exerted on the piston, causing sliding sleeve 950 to slide toward cutting surface 947 along first cutting head 946. This motion may cause expansion segments 948 to ride along the tapered surface of first cutting head 946, thereby increasing in diameter as sliding sleeve 950 advances. In some embodiments, expandable drill bit 944 may be rotated during this operation. In some embodiments, expansion segments 948 may include lateral cutting surface 949 to, for example, ream out intercept well 910 around first cutting head 946, forming an annular space for expansion segments 948 to expand into. Once fully extended, the faces of expansion segments 948 parallel with cutting surface 947 may be generally aligned therewith, thus expanding the width of cutting surface 947 to wider diameter d2. In some embodiments, the ratio of d2 to d1 may generally be between 1.1 and 1.8.

Additionally, hybrid expandable water-jet drill bit 944 may include at least one jet nozzle 960 positioned to jet a fluid 962 against target tubular 20. Fluid 962 may be pumped down bore 914 of casing entry string 942. In some embodiments, fluid 962 may be a mixture of high pressure fluid and abrasive material adapted to abrade target casing 20.

At this point, expandable drill bit 944 may be used to penetrate target tubular 20. The increase in diameter of expandable drill bit 944 may increase the overlap of cutting surface 947 over the centerline of target tubular 20, thereby, for example, minimizing walking as expandable drill bit 944 penetrates target tubular 20. In some embodiments, such an arrangement may allow intercept well 910 to be drilled at a smaller diameter while maintaining a larger diameter casing entry tool. Additionally, fluid 962 jetted from jet nozzle 960 against target tubular 20 may further aid in penetrating target tubular 20. In some embodiments, only fluid 962 is used to penetrate target tubular 20. In some embodiments, a whipstock as previously described may be utilized to create an angular deviation of water-jet drill bit 944 from intercept well 910.

In some embodiments, a casing orientation module may be used to, for example, properly align a casing entry mechanism of casing entry tool 30 with target tubular 20. In some embodiments in which a casing entry mechanism on casing entry tool 30 drills radially outward from intercept well 10, the casing entry mechanism must be properly directed toward target tubular 20. Additionally, for embodiments utilizing a whipstock as previously described, the whipstock may need to be properly directed toward target tubular 20. Additionally, a bent housing motor or an articulating mud motor as previously described would also need to be properly directed toward target tubular 20 as it is transitioned from the straight to the bent configuration.

Figure 8B:
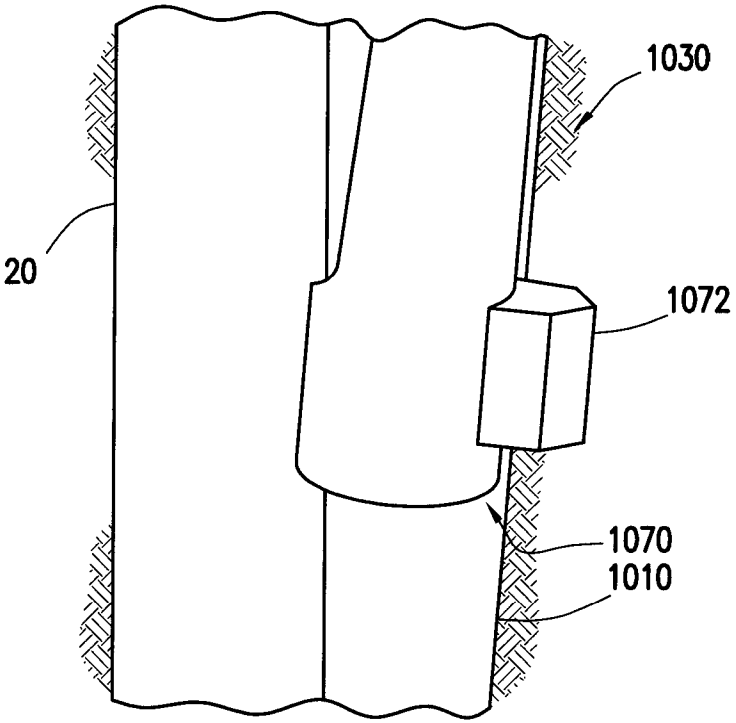
FIGS. 8*a*, 8*b* are elevation views of an orientation module consistent with at least one embodiment of the present disclosure.
Figure 8A:
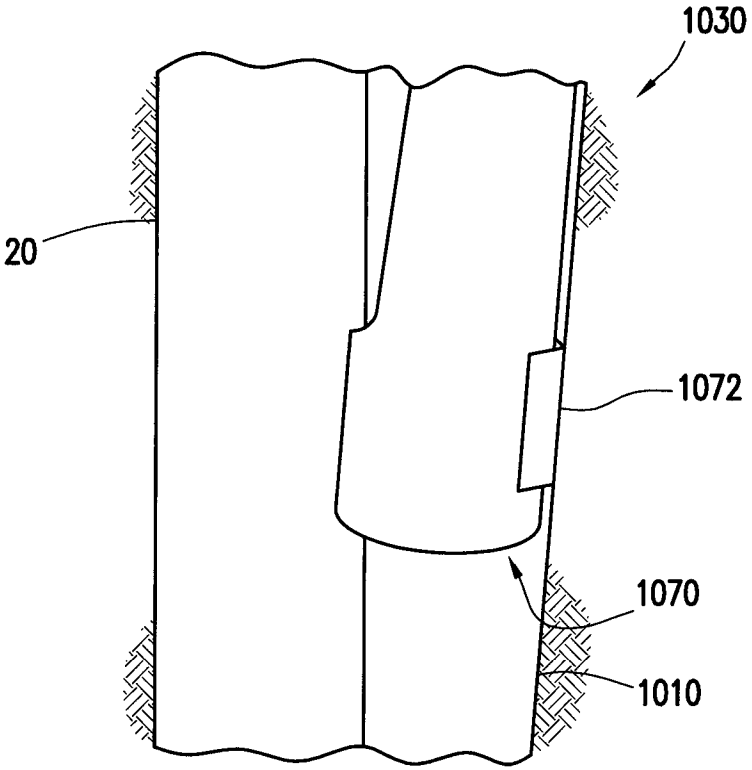

In some embodiments, such as that depicted in FIGS. 8*a*, 8*b*, casing entry tool 1030 may need to be oriented such that a face of casing entry tool 1030 is oriented to point toward target tubular 20, the face of casing entry tool 1030 being the side of casing entry tool 1030 adapted to form the aperture in target tubular 20. In some embodiments, casing entry tool 1030 may include orientation locking mechanism 1070. In some embodiments, casing entry tool 1030 may include a MWD apparatus (not shown) which may use, for example and without limitation, one or more magnetometers to sense target tubular 20 as casing entry tool 1030 is rotated within intercept well 1010. In some embodiments, casing entry tool 1030 may be rotated a first time to measure magnetic flux in a 360 degree arc. In some embodiments, by determining the angle at which magnetic flux is highest, casing entry tool 1030 may determine the proper orientation at which casing entry mechanism (not shown) will be oriented to face target tubular 20. Casing entry tool 1030 may then continue to rotate until the proper orientation is achieved. In some embodiments, casing entry tool 1030 may include, for example, a short-hop communication apparatus between one or more sensors in casing entry tool 1030 and a MWD apparatus located elsewhere on the tool string.

In some embodiments, casing entry tool 1030 may include locking mechanism 1072. Locking mechanism 1072 may be deployed to maintain casing entry tool 1030 in the proper orientation. In some embodiments, locking mechanism 1072 as depicted in FIGS. 8*a*, 8*b* may be a locking pawl, but one having ordinary skill in the art with benefit of this disclosure will understand that locking mechanism 1072 may be replaced with any suitable mechanism, including, for example and without limitation, a spring, hydraulic piston, mechanical actuator, percussive spike, or inflatable bladder without deviating from the scope of this disclosure. Locking mechanism 1072 may be retained in a retracted position as shown in FIG. 8*a* while casing entry tool 1030 is inserted into intercept well 1010 and during positioning. When in the retracted position, locking mechanism 1072 may remain generally within the housing of casing entry tool 1030. When deployed as depicted in FIG. 8*b*, locking mechanism 1072 may extend outward from casing entry tool 1030 and may engage the wall of intercept well 1010. Locking mechanism 1072 may thereby prevent any additional rotation and may maintain the proper orientation for the casing entry mechanism to penetrate target tubular 20. Locking mechanism 1072 may be deployed by, for example and without limitation, hydraulic pressure, spring pressure, or by mechanical action.

Figure 9B:
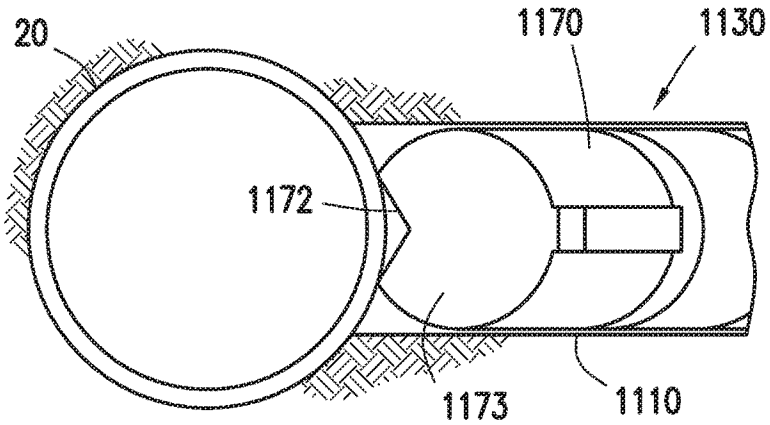
FIGS. 9*a*, 9*b* are elevation views of an orientation module consistent with at least one embodiment of the present disclosure.
Figure 9A:
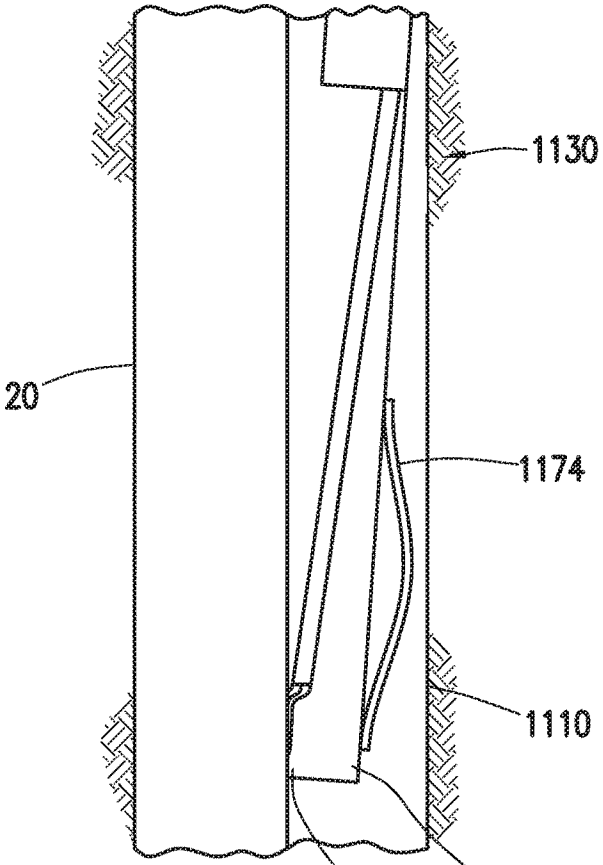

In some embodiments, casing entry tool 1130 as depicted in FIGS. 9*a*, 9*b* may include notched orientation module 1170. In some embodiments, notched orientation module 1170 may be positioned at the lower extent of casing entry tool 1130. Intercept well 1110 may be drilled such that a portion of target tubular 20 is exposed to intercept well 1110. Notched orientation module 1170 may include generally concave notch 1172 on feeler plate 1173 corresponding with the radial direction the casing entry mechanism will be oriented to face target tubular 20. In some embodiments, notched orientation module 1170 may include biasing apparatus 1174. Biasing apparatus 1174 may be adapted to force notched orientation module 1170 against the wall of intercept well 1110. FIG. 9*a* depicts biasing apparatus 1174 as a centralizer type spring, but one having ordinary skill in the art with the benefit of this disclosure will understand that biasing apparatus 1174 may be replaced with any suitable means, including, for example and without limitation, a leaf spring, hydraulic piston, sprung-wheel, inflatable bladder, or bar linkage without deviating from the scope of this disclosure. In some embodiments, as casing entry tool 1130 is rotated within intercept well 1110, notch 1172 may engage with the exposed generally convex portion of target tubular 20, thereby locking casing entry tool 1130 in the proper orientation. One having ordinary skill in the art with the benefit of this disclosure will understand that in some embodiments, notched orientation module 1170 may be used with orientation locking mechanism 1070 to further prevent any additional rotation.

Figure 10B:
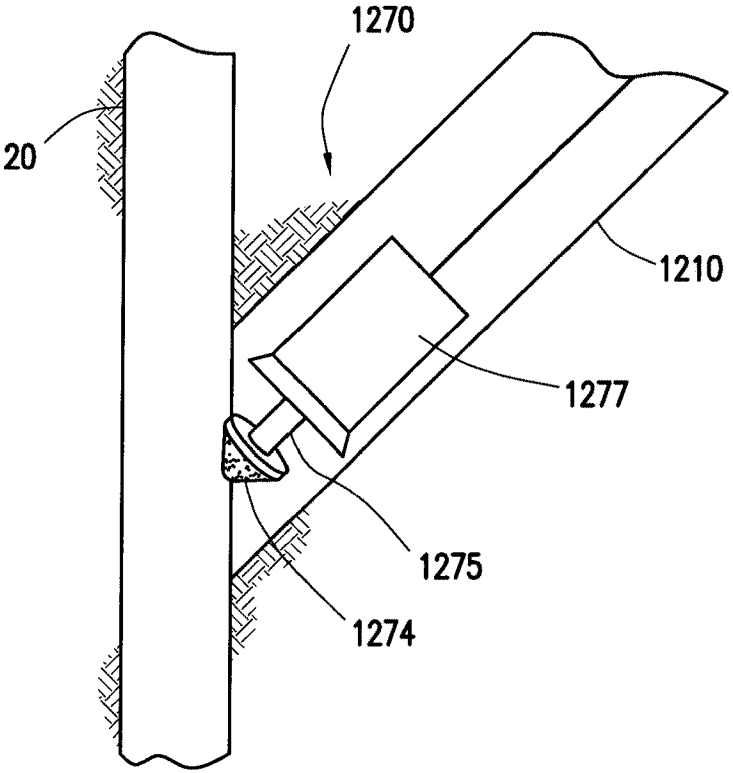
FIG. 10*b* is an elevation view of the powered dual-cone casing entry tool of FIG. 12*a*.
Figure 10A:
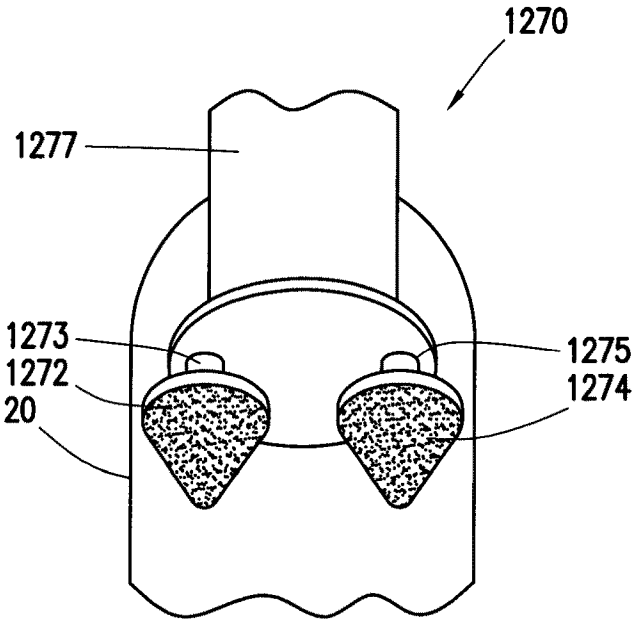
FIG. 10*a* is a partial perspective view of a powered dual-cone casing entry tool consistent with at least one embodiment of the present disclosure.

In some embodiments, as depicted in FIGS. 10*a*, 10*b*, powered dual cone casing entry bit 1270 may be used to enter target tubular 20. Powered dual cone casing entry bit 1270 may be positioned by a whipstock (not shown) or by an intercept well 1210 which meets target tubular 20 at an angle. Powered dual cone casing entry bit 1270 may include a first and second drilling cone 1272, 1274 mounted through axles 1273, 1275 to motor body 1277. Motor body 1277 may include a drive motor (not shown) adapted to drive first and second drilling cones 1272, 1274 in opposite directions through, for example, a gear box while pressure against target tubular 20 is applied. Contrarotation of first and second drilling cones 1272, 1274 may, for example, help maintain alignment with the convex outer surface of target tubular 20 and prevent walking as previously described.

Figure 11B:
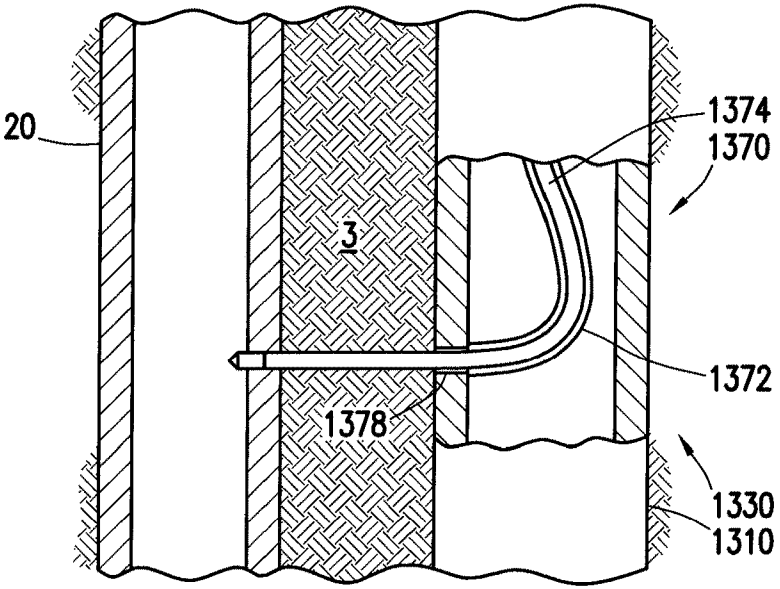
FIGS. 11*a*, 11*b* are partial cross-sections of a radial drilling apparatus consistent with at least one embodiment of the present disclosure.
Figure 11A:
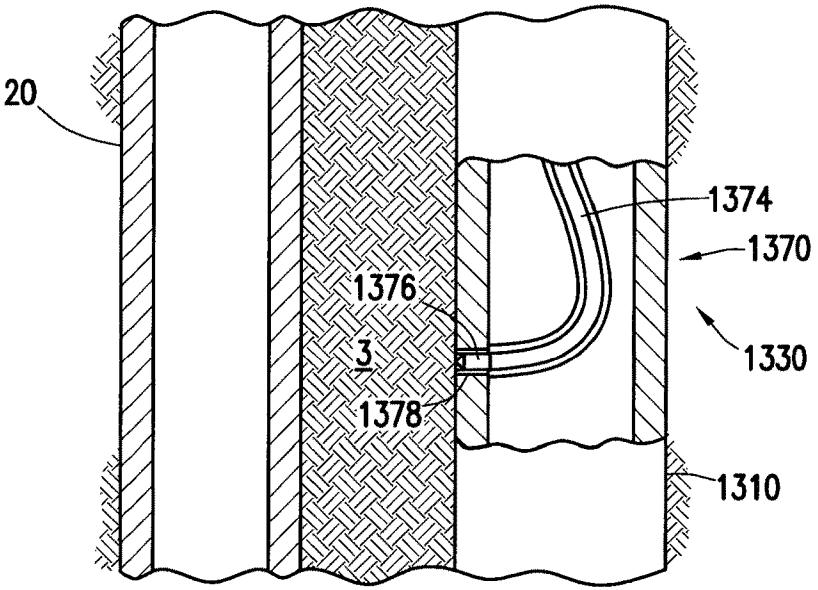

In some embodiments, casing entry tool 30 may include a casing entry mechanism which extends directly through the sidewall of intercept well 10. For example, FIGS. 11*a*, 11*b* depict a casing entry tool 1330 which include radial drilling apparatus 1370. Radial drilling apparatus 1370 may include curved tool path 1372 adapted to allow a flexible or articulating drill shaft 1374 to pass therethrough. Drill shaft 1374 may include radial drill bit 1376 at its front end. Curved tool path 1372 is positioned such that a movement of the back end of drill shaft 1374 in a direction parallel with intercept well 1310 may cause the front end of drill shaft 1374 and radial drill bit 1376 to extend radially outward from casing entry tool 1330 through aperture 1378. Having oriented casing entry tool 1330 with respect to target tubular 20 by, for example, one of the previously discussed orientation modules, radial drill bit 1376 may be pointed toward target tubular 20. Radial drill bit 1376, as it extends, may penetrate any earthen formation 3 remaining between intercept well 1310 and target tubular 20. On contact with target tubular 20, radial drill bit 1376 may then penetrate target tubular 20. One having ordinary skill in the art with the benefit of this disclosure will understand that radial drill bit 1376 may be any drill bit suited for the task of drilling through target tubular 20, including but not limited to traditional drill bits, water-jet drill bits, hybrid water-jet drill bits, face milling tools, or coring bits. Casing entry tool 1330 may be included on the drill string (not shown) used to drill intercept well 1310, or may be lowered on, for example, a tool string, coiled tubing, wireline, or slickline after the drill string is retracted. In some embodiments, drill shaft 1374 may be included within casing entry tool 1330 when it is inserted into intercept well 1310. In such a case, drill shaft 1374 may be extended by hydraulic pressure, movement of the tool string, etc. In some embodiments, a portion of radial drilling apparatus 1370 including curved tool path 1372 may be set in position within intercept well 1310 oriented with target tubular 20. A second portion of radial drilling apparatus 1370 including drill shaft 1374 and radial drill bit 1376 may then be lowered into intercept well 1310 such that radial drill bit 1376 and drill shaft 1374 move through curved tool path 1372. In some embodiments, a first drilling operation may be used to penetrate any remaining formation between intercept well 1310 and target tubular 20. A second drilling operation may then penetrate target tubular 20. Different drill bits may be utilized to drill each material in each drilling operation. In some embodiments, the first radial drilling action may be accomplished with the same radial drilling apparatus 1370 as the one housing coring bit radial drill bit 1376. In other embodiments, the first radial drilling action may be accomplished with a second radial drilling apparatus (not shown). Second radial drilling apparatus may be located within the same or a different casing entry tool 1330.

In some embodiments, in which radial drill bit 1376 is a rotary-type drill bit, radial drill bit 1376 may be rotated together with or separately from drill shaft 1374 by, for example, a mud motor, an electric motor, or rotation of the tool string. In embodiments where a water-jet type bit is used, high pressure fluid and abrasive material may be pumped through drill shaft 1374 and through radial drill bit 1376 to cut through any remaining earthen formation 3 and into target tubular 20. Radial drill bit 1376 may be rotated to, for instance, remove cuttings and other debris. In some embodiments, radial drill bit 1376 may be a coring bit configured with an annular cutting face adapted to cut a disc from target tubular 20. Such a radial drill bit 1376 may require a first pass to cut through any remaining earthen formation 3 between intercept well 1310 and target tubular 20. Coring type radial drill bit 1376 may then be extended through the formation to cut target tubular 20. In some embodiments, the disc cut from target tubular 20 may be recovered to the surface to, for example, prove successful entry of target casing.

Figure 12B:
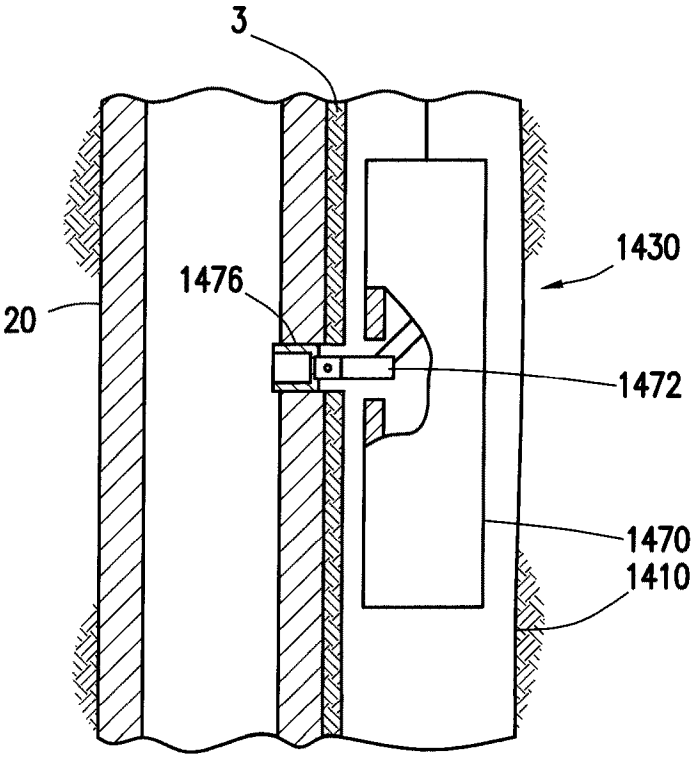
FIGS. 12*a*, 12*b* are partial cross-sections of a side-wall coring tool consistent with at least one embodiment of the present disclosure.
Figure 12A:
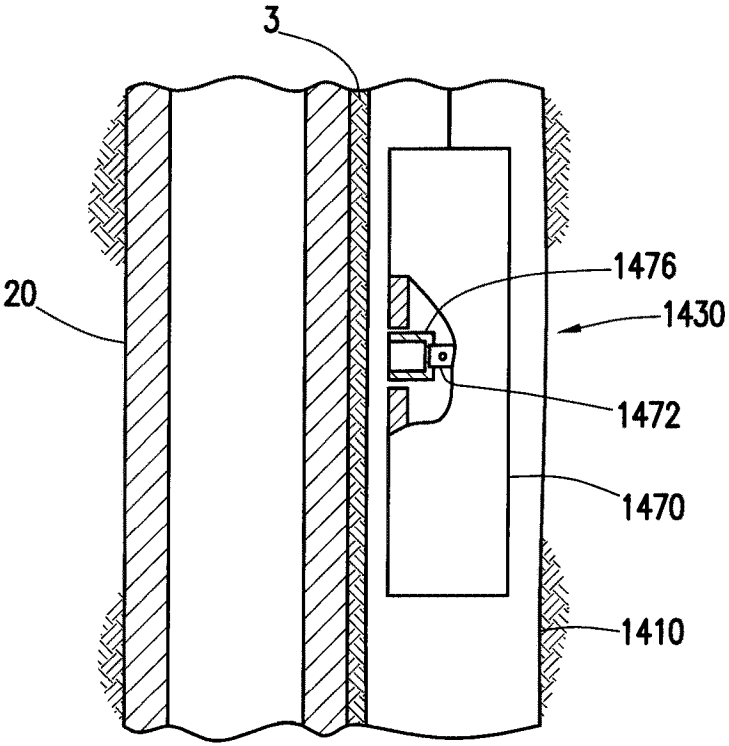

In some embodiments, such as that depicted in FIGS. 12*a*, 12*b*, casing entry tool 1430 may include radial drilling apparatus 1470. Radial drilling apparatus 1470 may include articulating arm 1472 including radial drill bit 1476 at its front end. Articulating arm 1472 may be adapted to extend radially from radial drilling apparatus 1470. Having oriented casing entry tool 1430 with respect to target tubular 20 by, for example, one of the previously discussed orientation modules, radial drill bit 1476 may be pointed toward target tubular 20. Radial drill bit 1476, as it extends, may penetrate any earthen formation 3 remaining between intercept well 1410 and target tubular 20. On contact with target tubular 20, radial drill bit 1476 may then penetrate target tubular 20. One having ordinary skill in the art with the benefit of this disclosure will understand that radial drill bit 1476 may be any drill bit suited for the task of drilling through target tubular 20, including but not limited to traditional drill bits, expandable drill bits, water-jet drill bits, hybrid water-jet drill bits, rotary cone bits, face milling tools, or coring bits. In some embodiments, casing entry tool 1430 may be included on the drill string (not shown) used to drill intercept well 1410. In some embodiments, casing entry tool 1430 may be lowered on, for example, a tool string, coiled tubing, wireline, or slickline after drill string is retracted. In some embodiments, articulating arm 1472 may be controlled by hydraulic pressure. In other embodiments, articulating arm 1472 may be controlled by one or more electric motors.

In some embodiments, radial drill bit 1476 may be a coring bit configured with an annular cutting face to cut a disc from target tubular 20. Such a radial drill bit 1476 may require a first radial drilling action to cut through any remaining earthen formation 3 between intercept well 1410 and target tubular 20 using a bit type other than a coring bit. Coring bit radial drill bit 1476 may then be extended through the formation to cut target tubular 20. In some embodiments, the disc cut from target tubular 20 may be recovered to the surface to, for example, prove successful entry of target casing. In some embodiments, the first radial drilling action may be accomplished with the same radial drilling apparatus 1470 as the one housing coring bit radial drill bit 1476. In other embodiments, the first radial drilling action may be accomplished with a second radial drilling apparatus (not shown). Second radial drilling apparatus may be located within the same or a different casing entry tool 1430. In some embodiments, the coring bit may be utilized repeatedly to cut multiple apertures in target tubular 20, and retrieve multiple discs.

Figure 13B:
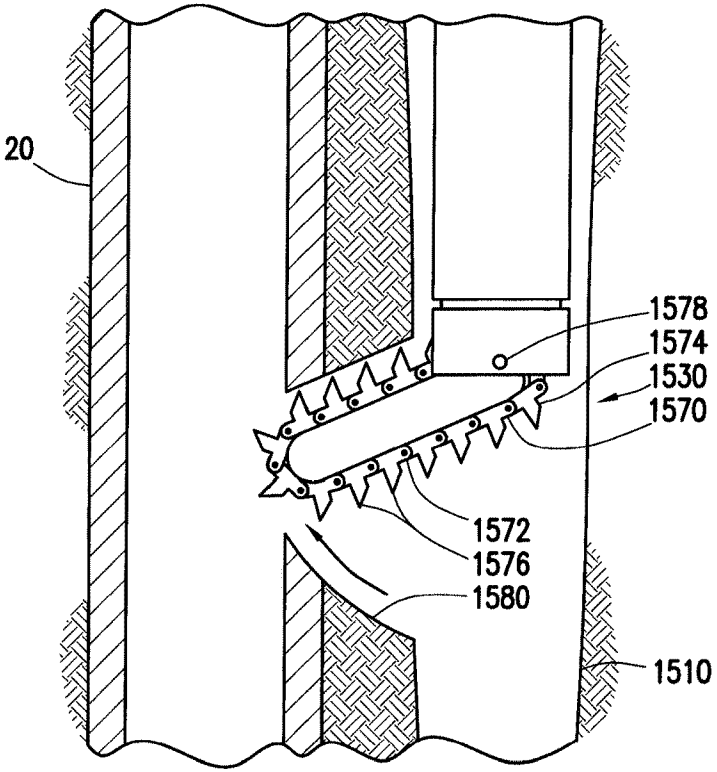
FIGS. 13*a*, 13*b* are partial elevation views of a trencher-type casing entry tool.
Figure 13A:
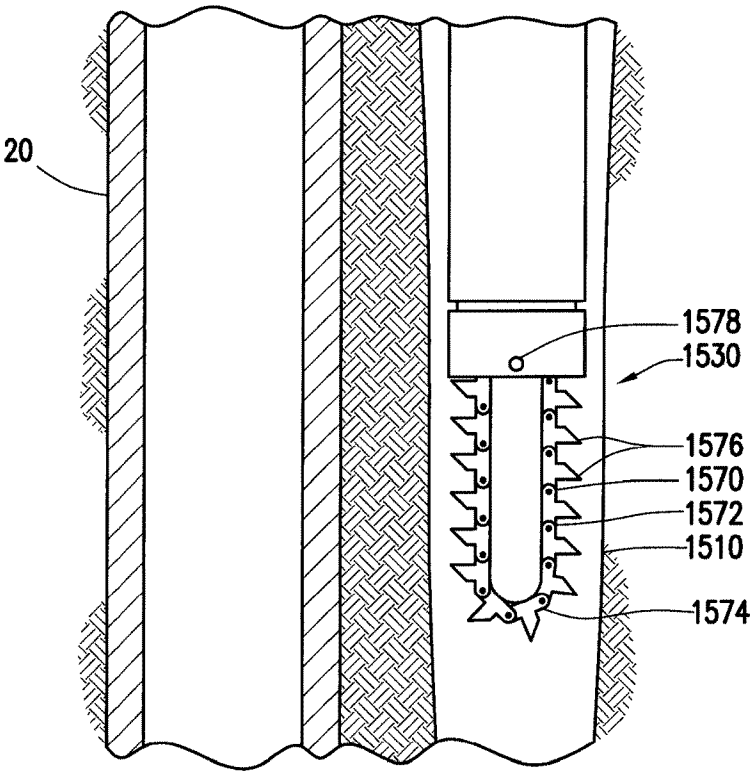

In some embodiments, casing entry tool 30 is designed with a casing entry mechanism which cuts through the sidewall of intercept well 10. For example, FIGS. 13*a*, 13*b* depict a casing entry tool 1530 which includes trenching tool 1570. In some embodiments, trenching tool 1570 may include guide bar 1572. Guide bar 1572 may include an edge slot around its perimeter adapted to guide trenching chain 1574 as it moves about the perimeter of guide bar 1572. In some embodiments, trenching chain 1574 may be constructed of multiple links positioned in a continuous circuit about guide bar 1572 and a motor assembly (not shown). At least a portion of the links may include one or more teeth 1576 designed to cut into a formation in contact with trenching chain 1574 as it is driven about guide bar 1572. In some embodiments, the motor assembly is electrically driven. In some embodiments, the motor assembly may be driven by a mud motor. In some embodiments, trenching tool 1570, in its retracted position, extends from the end of casing entry tool 1530 within intercept well 1510, allowing casing entry tool 1530 to be inserted into intercept well 1510. In other embodiments, trenching tool 1570 may be positioned within a generally tubular housing (not shown). In some embodiments, once casing entry tool 1530 is oriented with respect to target tubular 20 by, for example, one of the previously discussed orientation modules, trenching tool 1570 is pointed toward target tubular 20. Trenching tool 1570 may then be activated. Trenching chain 1574 may be driven around guide bar 1572 by the motor assembly. Trenching tool 1570 may then be pivoted about pivot point 1578 by, for example and without limitation, hydraulic or electronic means. Trenching tool 1570 may come into contact with surrounding formation 3 between intercept well 1510 and target tubular 20, and may cut a kerf 1580 therethrough. Trenching tool 1570 may continue to pivot into an extended position as depicted in FIG. 13*b* and may cut through target tubular 20. A movement of casing tool 1530 further into or out of intercept well 1510 may cause trenching tool 1570 to increase the size of kerf 1580 and thereby cut a larger opening between target tubular 20 and intercept well 1510.

In some embodiments, trenching tool 1570 may be included as part of the drilling string used to drill intercept well 1510. In some embodiments, trenching tool 1570 may be lowered into intercept well 1510 on, for example, a tool string, coiled tubing, wireline, or slickline after the drill string (not shown) used to drill intercept well 1510 has been retracted. In some embodiments, trenching tool 1570 may be positioned within a tubular sub (not shown). In some embodiments, trenching tool 1570 may extend into the extended position through a window in the side of the tubular sub.

Figure 14B:
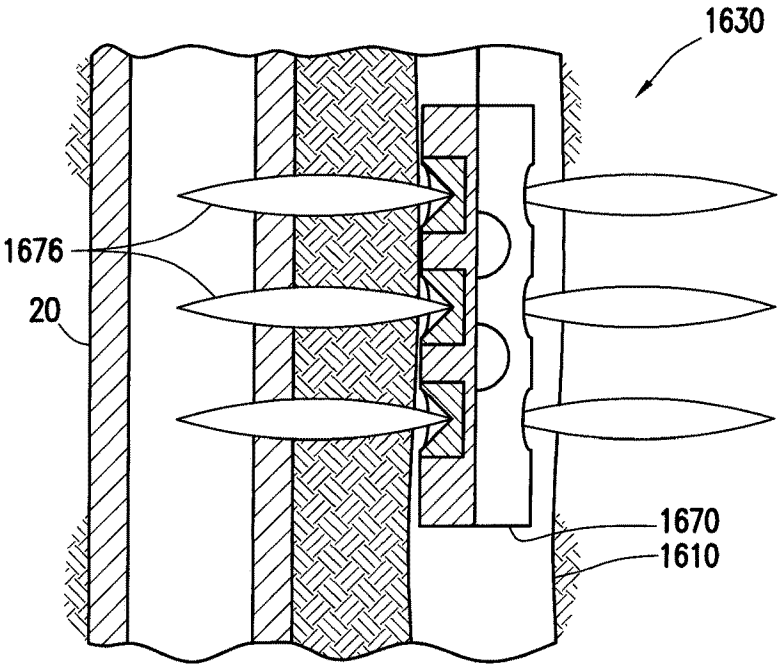
FIGS. 14*a*, 14*b* are partial cross-section views of a perforating-gun type casing entry tool consistent with at least one embodiment of the present disclosure.
Figure 14A:
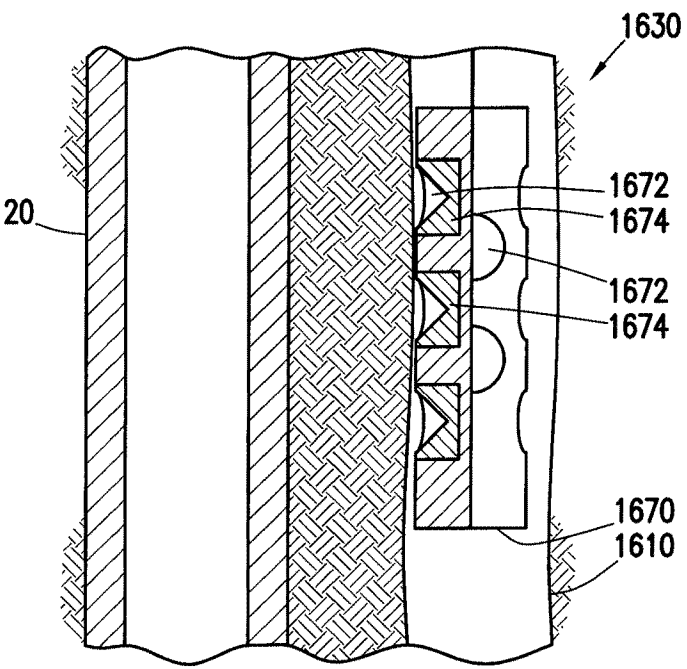

In some embodiments, casing entry tool 30 may be configured with a perforating gun type casing entry mechanism. As depicted in FIGS. 14*a*, 14*b*, casing entry tool 1630 may include perforating gun 1670 which may include about its periphery at least one shaped charge 1672. As understood in the art, shaped charge 1672 may include at least an explosive compound positioned within a cavity 1674 in the body of perforating gun 1670. Shaped charge 1672 may be designed to create a high-velocity jet 1676 upon detonation of shaped charge 1672 which may penetrate the surrounding formation 3 and target tubular 20 (FIG. 14*b*). Perforating gun 1670 may be lowered into intercept well 1610 on, for example, a tool string, coiled tubing, wireline, or slickline after the drill string (not shown) used to drill intercept well 1610 has been retracted. Perforating gun 1670 may include multiple shaped charges 1672 arranged about the perimeter of perforating gun 1670.

In some embodiments, shaped charges 1672 may be arranged about the full periphery of perforating gun 1670 in, for example, a helical pattern. Such an arrangement would allow perforating gun 1670 to perforate surrounding formation 3 in multiple radial directions. In such an embodiment, specific orientation of perforating gun 1670 would not be critical to achieve perforation of target tubular 20 as long as target tubular 20 is within the range of perforating jets 1676. In some embodiments, shaped charges 1672 may be arranged helically about perforating gun 1670. In other embodiments, shaped charges 1672 are arranged in a linear fashion along only one side of perforating gun 1670. In such an arrangement, perforating jets 1676 may cut in substantially one direction, thereby, for example, decreasing damage to intercept well 1610. In such an arrangement, an orientation module such as one previously discussed may be utilized to accurately "aim" shaped charges 1672 toward target tubular 20.

Figure 15B:
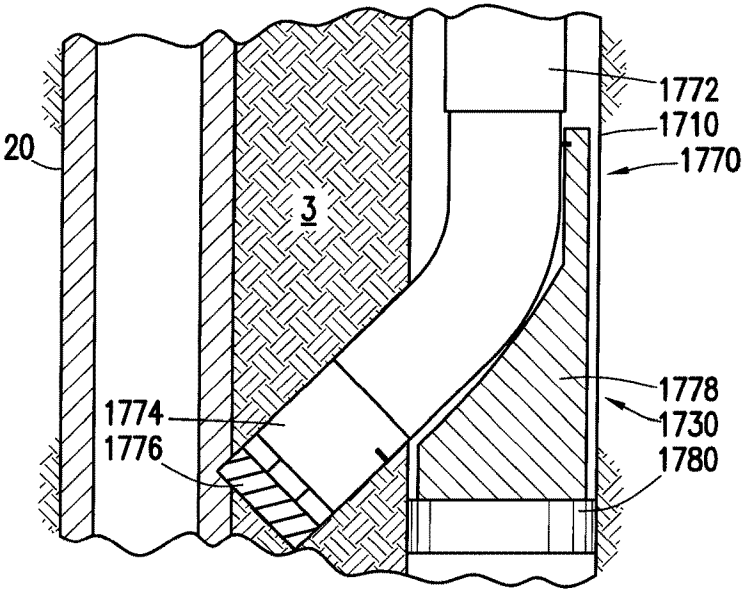
FIGS. 15*a*, 15*b* are partial cross section views of a shear-linked integral whipstock casing entry apparatus consistent with at least one embodiment of the present disclosure.
Figure 15A:
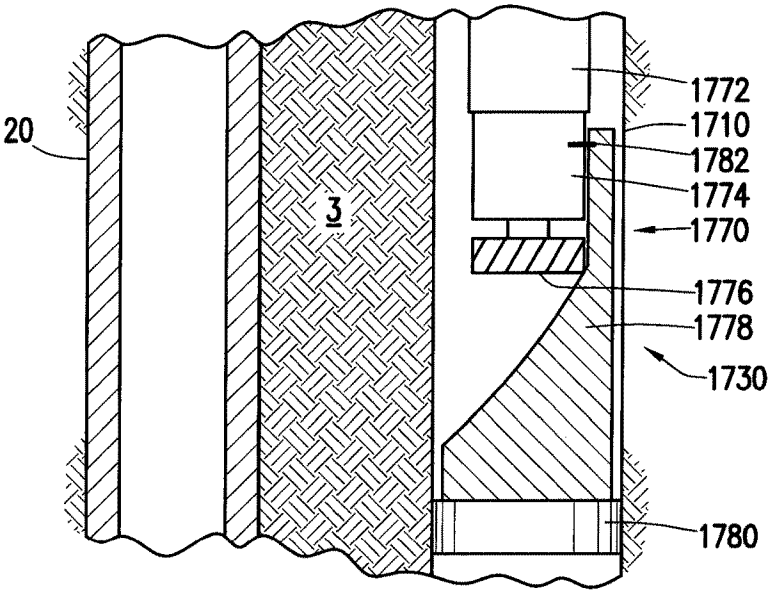

In some embodiments, such as that depicted in FIGS. 15*a*, 15*b*, casing entry tool 1730 may include shear-linked integral whipstock casing entry apparatus 1770. In some embodiments, shear-linked integral whipstock casing entry apparatus 1770 may be inserted into intercept well 1710 after the drill string used to form intercept well 1710 is removed therefrom.

In some embodiments, shear-linked integral whipstock casing entry apparatus 1770 may be located within drill string 1772. In some embodiments, drill string 1772 may be used to drill intercept well 1710 to intercept target tubular 20. Shear-linked integral whipstock casing entry apparatus 1770 may be positioned spaced apart from the drill bit (not shown) used to drill intercept well 1710.

Shear-linked integral whipstock casing entry apparatus 1770 may include mud motor 1774 coupled to drill string 1772, and drill bit 1776 operatively coupled to mud motor 1774. Mud motor 1774 and drill bit 1776 may be mechanically connected to whipstock 1778 included in shear-linked integral whipstock casing entry apparatus. Although described as a hydraulic type motor, one having ordinary skill in the art with the benefit of this disclosure will understand that mud motor 1774 may instead be an electric motor, hydraulic motor, or pneumatic motor. One having ordinary skill in the art with the benefit of this disclosure will also understand that rotational force may instead be provided from the surface by, for example and without limitation, a top drive or rotary table. In some embodiments, mud motor 1774 and drill bit 1776 may be mechanically connected to whipstock 1778 by a release mechanism such as shear pin 1782 or a mechanical retracting lock mechanism. In some embodiments, whipstock 1778 may be formed as an interior surface of a whipstock body 1779. Whipstock body 1779 may be a generally tubular body having window 1781 aligned with whipstock 1778 through which mud motor 1774 and drill bit 1776 may extend as discussed below. In some embodiments, mud motor 1774 may be configured to be disabled during the drilling process while it is mechanically connected to whipstock 1778, thereby preventing rotation of drill bit 1776. Once drilling is completed, in some embodiments, shear-linked integral whipstock casing entry apparatus may be oriented toward target casing 20 by, for example, an orientation module such as one previously discussed. In some embodiments, a locking mechanism such as one previously discussed may be engaged to retain whipstock 1778 in the proper orientation. In some embodiments, in which the release mechanism is shear pin 1782, the weight on bit may be increased so as to shear shear pin 1782, thus disconnecting mud motor 1774 and drill bit 1776 from whipstock 1778. In some embodiments in which the release mechanism is a mechanical retracting lock mechanism is utilized, the mechanical retracting lock mechanism may retract to disconnect mud motor 1774 and drill bit 1776 from whipstock 1778. The mechanical retracting lock mechanism may, as understood in the art, be actuated by, for example and without limitation, mechanical action, electrical action, or hydraulic pressure. In some embodiments, shear-linked integral whipstock casing entry apparatus may include a device to maintain its position and resist the weight on bit increase. FIGS. 15*a*, 15*b* depict an inflatable packer 1780 for this purpose.

Once separated from whipstock 1778 and whipstock 1778 is retained in position within the wellbore, mud motor 1774, in response to a fluid pumped through drill string 1772, may rotate drill bit 1776, which may be pushed outward by whipstock 1778 as drill string 1772 is lowered further into the wellbore. Drill bit 1776 may extend toward and penetrate target tubular 20. In some embodiments, shear-linked integral whipstock casing entry apparatus 1770 may include a cycle valve positioned to allow or prevent fluid from running the mud motor.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A downhole tool for penetrating an existing tubular positioned within an earthen formation from the surface, the downhole tool comprising:

a casing entry tool adapted to form at least one aperture in the existing tubular, the casing entry tool positioned in an intercept well formed in the earthen formation, the existing tubular positioned in an existing wellbore, the aperture formed by the casing entry tool from the intercept well, the intercept well intercepting the existing wellbore, the casing entry tool including a face, the casing entry tool including a feeler plate having a generally concave notch, the generally concave notch adapted to engage with a convex outer surface of the existing tubular, the notch oriented in the same radial direction as the face of the casing entry tool.

2. The downhole tool of claim 1, further comprising a biasing mechanism positioned to press the notch against the existing tubular.

3. The downhole tool of claim 2, wherein the biasing mechanism comprises one or more of a leaf spring, hydraulic piston, sprung-wheel, inflatable bladder, or bar linkage.

4. The downhole tool of claim 1, wherein the casing entry tool comprises a shear-linked integral whipstock casing entry apparatus, the shear-linked integral whipstock casing entry apparatus including:

a motor;

a casing entry drill bit operatively connected to the motor;

a whipstock body, the whipstock body being generally tubular and having a whipstock formed as an interior surface thereof, the whipstock body having a window formed therein and generally aligned with the whipstock and the notch; and a release mechanism adapted to connect the motor to the whipstock body, the release mechanism adapted to retain the motor and the casing entry drill bit generally within the whipstock body during a run-in operation, and the whipstock adapted to direct the casing entry drill bit outward from the whipstock body into the surrounding formation and the existing tubular.

5. The downhole tool of claim 4, wherein the release mechanism comprises a shear pin adapted to shear in response to an increased weight on bit.

6. The downhole tool of claim 4, wherein the release mechanism comprises a mechanical retracting lock mechanism adapted to release the motor and casing entry drill bit from the whipstock body in response to one of mechanical, hydraulic, or electric actuation.

7. The downhole tool of claim 4, wherein the motor comprises one of a mud motor, electric motor, top drive, or rotary table.

8. The downhole tool of claim 4, wherein the casing entry drill bit comprises an expandable bit drill bit, the expandable bit drill bit including:

a first cutting head, the first cutting head being generally a tapered cylinder having a body and a first cutting surface having a first diameter, and the body narrowing in diameter away from first cutting surface;

a shift sleeve slidingly coupled to the outer surface of the first cutting head;

at least one expansion segment positioned beside first cutting head and coupled to the shift sleeve, the shift sleeve selectively positionable so that the at least one expansion segment is extended in a direction toward the first cutting surface and sliding along the tapered body of the first cutting head so that the diameter of the cutting surface is increased by the thickness of the at least one expansion segment to a second diameter.

9. The downhole tool of claim 8, wherein:

the expandable drill bit further comprises at least one water jet configured to eject a stream of high pressure fluid and abrasive material therethrough in the direction of cutting.

10. The downhole tool of claim 4, wherein the casing entry bit comprises a water-jet bit, the water-jet bit including:

at least one water jet configured to eject a stream of high pressure fluid and abrasive material therethrough in the direction of cutting.

11. The downhole tool of claim 4, wherein the casing entry bit comprises a powered dual cone casing entry bit, the powered dual cone casing entry bit including a first and second drilling cone, the first and second drilling cone coupled to a first and second axle respectively, first and second axle operatively coupled to the motor, the motor adapted to rotate first and second drilling cones in opposite directions when the powered dual cone casing entry bit is activated.

12. The downhole tool of claim 1, wherein the casing entry tool comprises a radial drilling apparatus, the radial drilling apparatus comprising:

a curved tool path, the curved tool path coupling an interior of the casing entry tool with the surrounding formation through an aperture, the aperture generally aligned with the notch;

a flexible drill shaft positioned within the curved tool path such that a movement of the flexible drill shaft within the curved tool path will cause the end of flexible drill shaft to extend generally radially from the intercept well; and a casing entry drill bit positioned on the end of flexible drill shaft adapted to drill generally radially outward from the intercept well as the flexible drill shaft moves within the curved tool path.

13. The downhole tool of claim 12, wherein the flexible drill shaft is extended from the intercept well by one of a hydraulic piston, a movement of a drill string in the intercept well, or an electromechanical apparatus.

14. The downhole tool of claim 12, wherein the casing entry drill bit comprises an expandable bit drill bit, the expandable bit drill bit including:

a first cutting head, the first cutting head being generally a tapered cylinder having a body and a first cutting surface having a first diameter, and the body narrowing in diameter away from first cutting surface;

a shift sleeve slidingly coupled to the outer surface of the first cutting head;

at least one expansion segment positioned beside first cutting head and coupled to the shift sleeve, the shift sleeve selectively positionable so that the at least one expansion segment is extended in a direction toward the first cutting surface and sliding along the tapered body of the first cutting head so that the diameter of the cutting surface is increased by the thickness of the at least one expansion segment to a second diameter.

15. The downhole tool of claim 14, wherein:

the expandable drill bit further comprises at least one water jet configured to eject a stream of high pressure fluid and abrasive material therethrough in the direction of cutting.

16. The downhole tool of claim 12, wherein the casing entry bit comprises a water-jet bit, the water-jet bit including:

at least one water jet configured to eject a stream of high pressure fluid and abrasive material therethrough in the direction of cutting.

17. The downhole tool of claim 12, wherein the casing entry bit comprises a coring bit.

18. The downhole tool of claim 12, wherein the casing entry bit comprises a face milling tool.

19. The downhole tool of claim 1, wherein the casing entry tool comprises a radial drilling apparatus, the radial drilling apparatus comprising:

an articulating arm; and a casing entry drill bit, the radial drill bit positioned at the end of the articulating arm, the articulating arm adapted to extend casing entry drill bit generally radially outward from the drill string, and the casing entry drill bit positioned to drill radially outward as the articulating arm extends from the drill string.

20. The downhole tool of claim 19, wherein the articulating arm is extended from the drill string by one of a hydraulic piston arrangement, a movement of the drill string, or an electromechanical apparatus.

21. The downhole tool of claim 19, wherein the casing entry drill bit comprises an expandable bit drill bit, the expandable bit drill bit including:

a first cutting head, the first cutting head being generally a tapered cylinder having a body and a first cutting surface having a first diameter, and the body narrowing in diameter away from first cutting surface;

a shift sleeve slidingly coupled to the outer surface of the first cutting head; and at least one expansion segment positioned beside first cutting head and coupled to the shift sleeve, the shift sleeve selectively positionable so that the at least one expansion segment is extended in a direction toward the first cutting surface and sliding along the tapered body of the first cutting head so that the diameter of the cutting surface is increased by the thickness of the at least one expansion segment to a second diameter.

22. The downhole tool of claim 21, wherein:

the expandable drill bit further comprises at least one water jet configured to eject a stream of high pressure fluid and abrasive material therethrough in the direction of cutting.

23. The downhole tool of claim 19, wherein the casing entry bit comprises a water-jet bit, the water-jet bit including:

at least one water jet configured to eject a stream of high pressure fluid and abrasive material therethrough in the direction of cutting.

24. The downhole tool of claim 19, wherein the casing entry bit comprises a coring bit.

25. The downhole tool of claim 19, wherein the casing entry bit comprises a face milling tool.

26. The downhole tool of claim 1, wherein the casing entry tool comprises a trenching tool, the trenching tool comprising:

a motor assembly;

a guide bar having an edge slot around its perimeter, the guide bar pivotally attached to a tubular section of the drill string, the tubular section having a window through which the guide bar may exit the tubular section, the window generally aligned with the notch;

a pivot assembly positioned to extend the guide bar from the tubular section; and a trenching chain, the trenching chain formed from a plurality of links forming a continuous loop fitting around the edge slot of the guide bar and rotationally driven by the motor assembly when the trenching tool is activated, the trenching chain including teeth positioned to cut a kerf in a formation which comes in contact with the trenching chain as it rotates around guide bar.

27. The downhole tool of claim 26, wherein the pivot assembly is actuated by a hydraulic piston, movement of the drill string, or electromechanical actuator.

28. The downhole tool of claim 1, wherein the casing entry tool comprises a perforating gun having a body and at least one shaped explosive charge.

29. The downhole tool of claim 28, wherein the at least one shaped explosive charge is aligned with the notch.

30. The downhole tool of claim 28, wherein the perforating gun comprises a plurality of shaped explosive charges, the plurality of shaped explosive charges arranged along one side of the perforating gun aligned with the notch.

31. The downhole tool of claim 28, wherein the perforating gun comprises a plurality of shaped explosive charges, the plurality of shaped explosive charges arranged about the exterior of the perforating gun, at least one shaped explosive charge of the plurality of shaped explosive charges aligned with the notch.

32. The downhole tool of claim 1, wherein the casing entry tool comprises a whipstock, the whipstock adapted to direct a casing entry drill bit outward from the whipstock body into the surrounding formation and the existing tubular in a direction corresponding generally to the radial direction of the notch.

33. The downhole tool of claim 1, further comprising at least one magnetometer adapted to detect magnetic anomalies within the formation surrounding the downhole tool.

34. The downhole tool of claim 1, wherein the casing entry tool further comprises a locking mechanism, the locking mechanism adapted to retain the casing entry tool at a generally fixed position within the intercept well.

35. The downhole tool of claim 34, wherein the locking mechanism comprises one or more of a pawl, spring, hydraulic piston, mechanical actuator, percussive spike, or inflatable bladder.

36. The downhole tool of claim 34, wherein the locking mechanism is actuated by one of hydraulic pressure, spring pressure, or by mechanical action.

37. A method of penetrating an existing tubular such as casing, tubing, or drillpipe positioned within an earthen formation from the surface, the method comprising:

providing a drilling rig;

providing a drill string, the drill string comprising:

a drill bit; and a bottomhole assembly;

drilling an intercept well;

steering the drill bit to intercept the existing tubular;

running a casing entry tool into the intercept well, the casing entry tool including a feeler plate having a generally concave notch adapted to engage with the convex outer surface of the existing tubular, the notch oriented in the same radial direction as a face of the casing entry tool;

orienting the casing entry tool toward the existing tubular; and cutting at least one aperture in the existing tubular with casing entry tool.

38. The method of claim 37, wherein the orienting operation further comprises:

rotating the casing entry tool;

engaging the existing tubular with the notch; and stopping rotation of the casing entry tool.

39. The method of claim 37, further comprising a biasing mechanism positioned to press the notch against the existing tubular.

40. The method of claim 37, wherein:

the casing entry tool comprises a shear-linked integral whipstock casing entry apparatus, the shear-linked integral whipstock casing entry apparatus including:

a motor;

a casing entry drill bit operatively connected to the motor;

a whipstock; and a release mechanism adapted to connect the motor to the whipstock; and the cutting operation further comprises:

actuating the release mechanism;

engaging the motor;

rotating the casing entry drill bit; and cutting at least one aperture in the existing tubular.

41. The method of claim 40, wherein the motor comprises one of a mud motor, electric motor, top drive, or rotary table.

42. The method of claim 40, wherein the release mechanism comprises a shear pin adapted to shear in response to an increased weight on bit; and the actuating the release mechanism operation comprises shearing the shear pin.

43. The method of claim 40, wherein the release mechanism comprises a mechanical retracting lock mechanism adapted to release the motor and casing entry drill bit from the whipstock by in response to one of mechanical, hydraulic, or electric actuation; and the actuating the release mechanism operation comprises actuating the mechanical retracting lock mechanism.

44. The method of claim 40, wherein the casing entry drill bit comprises an expandable bit drill bit, the expandable bit drill bit comprising:

a first cutting head, the first cutting head being generally a tapered cylinder having a body and a first cutting surface having a first diameter, and the body narrowing in diameter away from first cutting surface;

a shift sleeve slidingly coupled to the outer surface of the first cutting head;

at least one expansion segment positioned beside first cutting head and coupled to the shift sleeve, the shift sleeve selectively positionable so that the at least one expansion segment is extended in a direction toward the first cutting surface and sliding along the tapered body of the first cutting head so that the diameter of the cutting surface is increased by the thickness of the at least one expansion segment to a second diameter; and the cutting operation further comprises:

extending the at least one expansion segment; and cutting an aperture in the existing tubular with the casing entry drill bit.

45. The method of claim 44, wherein:

the expandable drill bit further comprises at least one water jet configured to eject a stream of high pressure fluid and abrasive material therethrough in the direction of cutting; and the cutting operation further comprises:

pumping a fluid containing an abrasive material through the at least one water jet; and cutting an aperture in the exiting casing with the stream of high pressure fluid and abrasive material.

46. The method of claim 40, wherein the casing entry bit comprises a water-jet bit, the water-jet bit comprising:

at least one water jet configured to eject a stream of high pressure fluid and abrasive material therethrough in the direction of cutting; and the cutting operation further comprises:

pumping a fluid containing an abrasive material through the at least one water jet; and cutting an aperture in the exiting casing with the stream of high pressure fluid and abrasive material.

47. The method of claim 40, wherein the casing entry bit comprises a powered dual cone casing entry bit, the powered dual cone casing entry bit including a first and second drilling cone, the first and second drilling cone coupled to a first and second axle respectively, first and second axle operatively coupled to a motor, the motor positioned to rotate first and second drilling cones in opposite directions when the powered dual cone casing entry bit is activated, and the cutting operation further comprises:

positioning the first and second drilling cone against the existing tubular;

activating the powered dual cone casing entry bit; and advancing the powered dual cone casing entry bit.

48. The method of claim 37, wherein the casing entry tool comprises a radial drilling apparatus, the radial drilling apparatus comprising:

a curved tool path;

a flexible drill shaft positioned within the curved tool path such that a movement of the flexible drill shaft within the curved tool path will cause the end of flexible drill shaft to extend radially from the drill string; and a radial drill bit positioned on the end of flexible drill shaft positioned to drill radially outward from the drill string as the flexible drill shaft moves within the curved tool path; and the cutting operation further comprises:

extending the flexible drill shaft from the drill string;

drilling through any earthen formation between the drill string and the existing tubular with the radial drill bit; and cutting at least one aperture in the existing tubular with the radial drill bit.

49. The method of claim 48, wherein the flexible drill shaft is extended from the drill string by one of a hydraulic piston, a movement of the drill string, or an electromechanical apparatus.

50. The method of claim 48, wherein the radial drill bit is one of a rotary drill bit, expandable drill bit, water-jet drill bit, hybrid water-jet drill bit, rotary cone bit, face milling tool, or coring bit.

51. The method of claim 37, wherein the casing entry tool comprises a radial drilling apparatus, the radial drilling apparatus comprising:

an articulating arm; and a radial drill bit, the radial drill bit positioned at the end of the articulating arm, the articulating arm positioned to extend radial drill bit radially outward from the drill string, and the radial drill bit positioned to drill radially outward as the articulating arm extends from the drill string; and the cutting operation further comprises:

drilling through any earthen formation between the drill string and the existing tubular with the radial drill bit; and cutting at least one aperture in the existing tubular with the radial drill bit.

52. The method of claim 51, wherein the articulating arm is extended from the drill string by one of a hydraulic piston arrangement, a movement of the drill string, or an electromechanical apparatus.

53. The method of claim 51, wherein the radial drill bit is one of a rotary drill bit, expandable drill bit, water-jet drill bit, hybrid water-jet drill bit, rotary cone bit, face milling tool, or coring bit.

54. The method of claim 37, wherein the casing entry tool comprises a trenching tool, the trenching tool comprising:

a motor assembly;

a guide bar having an edge slot around its perimeter, the guide bar pivotally attached to a tubular section of the drill string, the tubular section having a window through which the guide bar may exit the tubular section;

a pivot assembly positioned to extend the guide bar from the tubular section; and a trenching chain, the trenching chain formed from a plurality of links forming a continuous loop fitting around the edge slot of the guide bar and rotationally driven by the motor assembly when the trenching tool is activated, the trenching chain including teeth positioned to cut a kerf in a formation which comes in contact with the trenching chain as it rotates around guide bar; and the cutting operation further comprises:

activating the trenching tool;

pivoting the guide bar;

cutting a kerf in the surrounding earthen formation; and cutting a kerf in the existing tubular.

55. The method of claim 54, wherein the pivot assembly comprises a hydraulic piston or electromechanical actuator.

56. The method of claim 37, wherein the casing entry tool comprises a perforating gun having a body and at least one shaped explosive charge generally aligned with the notch, and the cutting operation further comprises:

detonating the at least one shaped explosive charge.

* * * * *